US005622527A

United States Patent [19]

Watterson et al.

[11] Patent Number: 5,622,527

[45] Date of Patent: Apr. 22, 1997

[54] INDEPENDENT ACTION STEPPER

[75] Inventors: Scott R. Watterson, River Heights; Brad Ellis; William T. Dalebout, both of Logan, all of Utah

[73] Assignees: Proform Fitness Products, Inc.; ICON Health & Fitness, Inc., Logan, Utah

[21] Appl. No.: 217,292

[22] Filed: Mar. 23, 1994

Related U.S. Application Data

[60] Division of Ser. No. 827,283, Jan. 29, 1992, abandoned, which is a continuation-in-part of Ser. No. 706,756, May 29, 1991, abandoned, which is a continuation-in-part of Ser. No. 647,554, Jan. 29, 1991, Pat. No. 5,135,216, and Ser. No. 644,456, Jan. 23, 1991, Pat. No. 5,062,627, said Ser. No. 827,283, is a continuation-in-part of Ser. No. 517,439, May 8, 1989, abandoned, which is a continuation-in-part of Ser. No. 258,994, Oct. 17, 1988, abandoned, which is a continuation-in-part of Ser. No. 861,050, May 8, 1986, Pat. No. 4,796,881.

[51] Int. Cl.[6] ..... A63B 23/04

[52] U.S. Cl. ..... 482/53; 482/112

[58] Field of Search ..... 482/52, 53, 72, 482/73, 111, 112, 127; 188/315, 322.15, 317; 92/130 C

[56] References Cited

U.S. PATENT DOCUMENTS

| | | | |
|---|---|---|---|
| D. 263,978 | 4/1982 | Brentham . | |
| D. 280,224 | 8/1985 | Wilson . | |
| D. 284,597 | 7/1986 | Smith et al. . | |
| 1,015,071 | 1/1912 | Reach | 482/73 |
| 1,969,901 | 8/1934 | Pilates . | |
| 2,209,034 | 7/1940 | Paul . | |
| 3,312,466 | 4/1967 | Melchiona . | |
| 3,473,843 | 10/1969 | Hart . | |
| 3,638,941 | 2/1972 | Kulkens . | |
| 3,647,209 | 3/1972 | LaLanne . | |
| 3,709,487 | 1/1973 | Walker . | |
| 3,770,267 | 11/1973 | McCarthy . | |
| 3,874,657 | 4/1975 | Niebojewski . | |
| 3,892,404 | 7/1975 | Martucci . | |
| 4,023,466 | 5/1977 | Strassheimer . | |
| 4,072,309 | 2/1978 | Wilson . | |
| 4,131,266 | 12/1978 | Carter | 188/315 |
| 4,140,312 | 2/1979 | Buchmann . | |
| 4,157,179 | 6/1979 | Ecklor, Jr. . | |
| 4,240,627 | 12/1980 | Brentham . | |
| 4,316,609 | 2/1982 | Silberman . | |
| 4,319,747 | 3/1982 | Rogers . | |
| 4,369,966 | 1/1983 | Silberman . | |
| 4,411,342 | 10/1983 | Katsumori et al. | 188/315 |
| 4,452,448 | 6/1984 | Ausherman . | |

(List continued on next page.)

FOREIGN PATENT DOCUMENTS

| | | | |
|---|---|---|---|
| 5110842 | 3/1976 | Japan | A63B 23/00 |

OTHER PUBLICATIONS

Owner's Manual for Weider Flex CTS Cross Training System for model No. 870300, Rev. Mar. 1990.

Versatile Exercise System; Abstract from Recreation, Sports & Leisure dated Feb. 1986 (p. 10).

Instruction Booklet for "Body Shop 360" by Weslo International Inc., P.O. Box 10, Logan UT 84321 (p. 1–30).

B.F. Goodrich "Torsilastic Springs". 5 pages, ©1986 copy located in 482/52.

Lifestyler 2200 Multi–action–rower Owner's Manual. copyright 1987.

*Primary Examiner*—Stephen R. Crow

*Attorney, Agent, or Firm*—Trask, Britt & Rossa

[57] ABSTRACT

A motivational exercise stepping machine has a pair of independently operable pivoting treadles for operation by a user's feet. Each treadle is connected to its own hydraulic cylinder device which provides resistance to downward movement of the treadle by a combination of fluid flow resistance and a biasing means. The treadle is biased upwardly by the biasing means. Fluid flow resistance is controlled to be less for upward movement than for downward movement of each treadle to permit the user to step at any desirable pace, yet motivate the user to maintain that pace.

7 Claims, 8 Drawing Sheets

U.S. PATENT DOCUMENTS

| | | | |
|---|---|---|---|
| 4,462,252 | 7/1984 | Smidt et al. . | |
| 4,477,071 | 10/1984 | Brown et al. . | |
| 4,480,832 | 11/1984 | Bulmash et al. . | |
| 4,492,375 | 1/1985 | Connelly . | |
| 4,521,013 | 6/1985 | Dofel . | |
| 4,563,001 | 1/1986 | Terauds . | |
| 4,572,500 | 2/1986 | Weiss . | |
| 4,582,320 | 4/1986 | Shaw . | |
| 4,600,187 | 7/1986 | Schenker . | |
| 4,600,196 | 7/1986 | Jones . | |
| 4,618,144 | 10/1986 | Gibson . | |
| 4,621,623 | 11/1986 | Wang . | |
| 4,627,619 | 12/1986 | Rockwell . | |
| 4,645,197 | 2/1987 | McFee | 482/53 |
| 4,690,398 | 4/1987 | Smith | 482/73 |
| 4,750,735 | 6/1988 | Furgerson et al. | 482/73 |
| 4,796,881 | 1/1989 | Watterson | 482/73 |
| 4,830,362 | 5/1989 | Bull . | |
| 4,836,543 | 6/1989 | Holzer . | |
| 4,838,543 | 6/1989 | Armstrong et al. | 482/53 |
| 4,852,874 | 8/1989 | Sleichter, III et al. . | |
| 4,944,518 | 7/1990 | Flynn . | |
| 5,000,440 | 3/1991 | Lynch . | |
| 5,062,627 | 11/1991 | Bingham . | |
| 5,071,115 | 12/1991 | Welch | 482/53 |
| 5,129,872 | 7/1992 | Dalton et al. | 482/127 |
| 5,135,216 | 8/1992 | Bingham et al. . | |

INDEPENDENT ACTION STEPPER

This application is a division of application Ser. No. 07/827,283, filed Jan. 29, 1992, (now abandoned), which is a continuation-in-part of application Ser. No. 07/706,756, filed May 29, 1991, (now abandoned), which is a continuation-in-part of application Ser. No. 07/647,554, filed Jan. 29, 1991, now U.S. Pat. No. 5,135,216 and application Ser. No. 07/644,456, filed Jan. 23, 1991, now U.S. Pat. No. 5,062,627, and this application is also a continuation-in-part of U.S. application Ser. No. 07/517,439, filed May 8, 1989 (now abandoned), which is a continuation of U.S. application Ser. No. 07/258,994, filed Oct. 17, 1988, (now abandoned), which is, in turn, a continuation-in-part of U.S application Ser. No. 06/861,050, filed May 8, 1986, which issued as U.S. Pat. No. 4,796,881 on Jan. 10, 1989.

BACKGROUND OF THE INVENTION

1. Field

This invention relates to exercise machines, and more particularly to stepping machines which stimulate the climbing of stairs or steps.

2. State of the Art

Stepping machines provide a form of aerobic exercise by simulating stair climbing. In such machines, the user's body is repeatedly lifted by alternatively shifting the user's weight from one foot to the other, each foot resting on its own treadle. As the weight is shifted to a treadle, the weight overcomes a resistive force to move the treadle downward. In conventional stepping machines, the treadles are interconnected so that as one treadle is pushed downward under the user's weight, the other treadle is mechanically moved an equal distance in the opposite direction, i.e., upward. Repetitive weighting and unweighting of the user on each treadle in a sinusoidal type reciprocating motion results in the aerobic exertion.

An example of a conventional stepping machine is shown in U.S. Pat. No. 4,830,362 of Bull. A pair of foot pedals or levers is interconnected to move in opposite directions. In addition, the apparatus includes a pair of handles interconnected in synchrony with the pedals.

Conventional stepping machines have treadles which are mechanically interconneced so that the treadle positions are always 180 degrees out of phase. Thus, as the left treadle is at the uppermost position, the right treadle is at the lowermost position. Downward movement of one treadle moves the other treadle and the foot placed thereon upward. This upward motion does not simulate the natural lifting of a foot from one step to the next upper step. The natural climbing or stepping movement deviates from a strict sinusoidal curve, the lifting of the unweighted foot occurring at a speed different from the weighting motion.

In conventional stepping machines, the interconnected treadles may be stopped at any position. In the most comfortable position, one foot is usually fully weighted to drive the associated treadle to a lowermost position. The other treadle is then at an uppermost position. If desired, the treadles may be equally weighted and both be maintained in an intermediate position. Thus, there is no machine driven motivation for the user to maintain a particular stepping speed.

SUMMARY OF THE INVENTION

As described herein, the invention is a stepper exercising apparatus which has completely independent foot treadles.

Each of the two foot treadles is spaced from the other, and is pivotally attached to a supporting frame. Each treadle is pivotable between (a) a first position to which the treadle is biased when unweighted by a user, and (b) a second position under the weight of a user. Typically, the first position is an upper or "ready" position, and the treadle moves to the second or lower position when weighted by a user's foot for a sufficiently long period.

The apparatus includes two independent force-exerting means acting on each treadle or pedal. First, a biasing means exerts a force to move and bias it toward the first position. The biasing means also acts to resist movement toward the second position. A second force exerting means comprises a hydraulic cylinder in which fluid flow from one side to the other side of a piston is restricted to create resistance to lineal movement of the piston and shaft within the cylinder. The cylinder and shaft end are connected to the stepper frame and treadle to resist treadle movement. A check valve(s) may be used to produce differing resistances depending on direction of piston movement. Thus, the resistance produced by the biasing means is a function of treadle position; and the resistance produced by the hydraulic cylinder is velocity dependent, not position dependent. Also, the velocity function may differ depending upon direction of movement.

Each treadle is pivotally connected to the supporting framework, the connection acting as the fulcrum of a lever.

The biasing means and the major resistance producing means, i.e. hydraulic cylinder, are each connected to the treadle at positions which achieve a desirable weighted treadle velocity at the particular user's weight and stepping speed.

The invention provides a treadle movement which simulates the natural climbing of steps.

The action of this apparatus may be also regarded as motivational in nature. More specifically, the user may be motivated by the machine action to maintain a minimum stepping speed. If the user's stepping speed is not fast enough, the treadle may drop to an undesireable lower position based on resistance setting. Lower speeds result in the user's foot and treadle dropping to a lower position on each step. Also the user may be motivated to step before the treadles hit the lowest position and in turn cause a bump or jar that some could view as undesirable.

As stepping speed is increased, the treadle typically pivots through a smaller angle, and the lower treadle position during the cycle is higher. In other words, the treadle pivots to a higher "low" position at higher stepping speeds. The user is motivated to maintain a minimum stepping speed to maintain operational comfort. There is no intermediate position at which the user may stop and rest, as in prior art machines with interconnected treadles.

The biasing means of this invention may be any apparatus which exerts a unidirectional force to return the treadle to a starting position. For example, a coil spring may be provided either inside or outside of the hydraulic cylinder. Alternatively, an elongate elastomeric member may be used, or a torsion spring may be placed between the frame and the treadle to bias the treadle to a first position.

Each treadle has its own hydraulic resistance system and biasing means. The operation of one treadle does not affect the operation of the other treadle, each being completely independent of the other. Thus, a user's operation of one treadle against a resistance device neither increases nor decreases the effective resistance to movement of the other treadle, nor does it require the other treadle to be operated at the same pace. A quick left foot step may be followed by a slow right foot step, for example.

Each treadle is separately controllable with respect to resistance affecting the weighted force in relation to the downward speed. The apparatus may be provided with means for controlling the resistance over a wide range, to compensate for variations in user weight and desired speed of stepping.

BRIEF DESCRIPTION OF THE DRAWINGS

In the drawings, which illustrate what is presently regarded as the preferred embodiments of the invention.

DETAILED DESCRIPTION OF THE INVENTION

Figure 1:
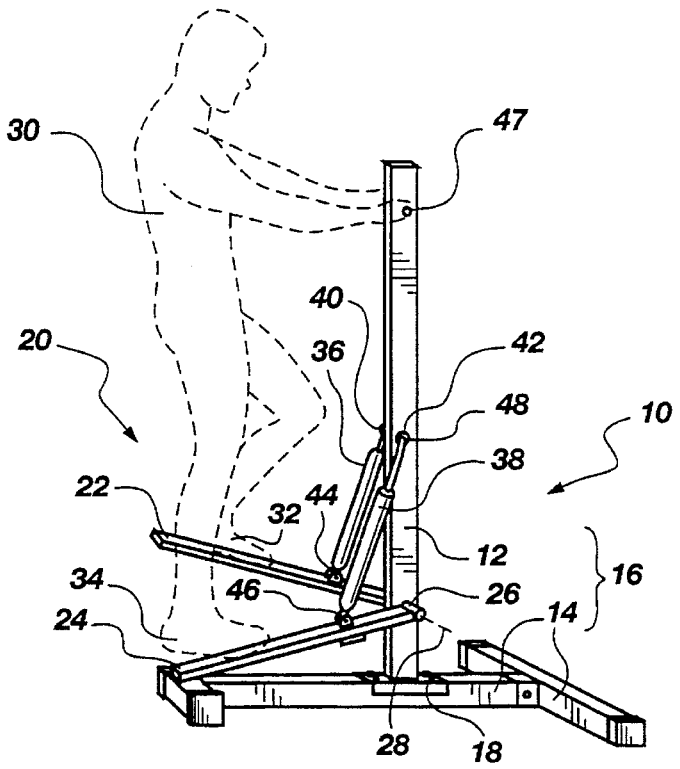
FIG. 1 is a perspective view of the stepper exerciser of the invention, illustrating a user performing aerobic exercise on the apparatus.

A stepper exercise machine 10 of the present invention is illustrated in FIG. 1. An upright frame member 12 is shown as extending upwardly from the base support 14 of the frame 16. Upright member 12 and base support 14 together comprise the frame 16. The frame 16 is typically a hollow tube member square in cross-section. However, the cross-section may be rectilinear, round, oval, or any other desired shape in which the frame 16 is sufficiently rigid to not deform in use. As shown, the base support 14 may be formed of a plurality of members joined by welding, bolting, etc. to provide stability to the stepper apparatus during use. The upright member 12 is shown as being removably connected to the base support 14 by bolts 18.

A stepper portion 20 of the apparatus 10 includes a pair of pedals or treadles 22, 24, generally designated a left treadle 22 and a right treadle 24, corresponding to a user's feet. The treadles provide a relatively flat surface for mounting of a user's feet. The treadles 22, 24 are pivotally mounted to the upright member 12 by treadle mounting means 26, and pivot about axis 28. The treadles act as levers pivoted about a fulcrum at axis 28. The user 30 places a left foot 32 on the treadle 22 and a right foot 34 on treadle 24. The user 30 is shown in FIG. 1 as posing in a portion of the exercise cycle where the left foot 32 is unweighted, permitting the treadle to rise to an upper or ready position and the right foot 34 is fully weighted to force the right treadle to a lower position.

The stepper portion 20 also includes hydraulic cylinder devices 36 and 38 which may combine treadle resistance means and biasing means in a single unit. Cylinder device 36 has one end 40 pivotally attached to upright member 12 and the opposite end attached to treadle 22. Likewise, cylinder device 38 has one end 42 pivotally attached to upright member 12 and the opposite end attached to treadle 24. Thus, the treadles 22, 24 operate completely independently from each other.

Typically, the upper ends 40, 42 of the cylinder devices 36, 38 are both attached to upright member 12 by connection means which is here shown as a bolt 48 fixed to the upper ends of both cylinder devices 36, 38 and passing through holes formed in the upright frame member 12.

As can be seen, each of the hydraulic cylinder devices 36, 38 is detachably connected to the corresponding treadle 22, 24.

Each of the treadles 22, 24 is independently biased to an upward position, illustrated by treadle 22. In addition, the resistance means for each treadle resists downward movement of the treadles 22, 24 under the user's weight, but permits the biasing means to lift the treadles upwardly when unweighted, thus following the user's unweighted foot without forcing it to be in a particular position relative to the weighted foot. The devices 36, 38 are further discussed infra with respect to FIGS. 3, 4 and 10.

Also shown in FIG. 1 are handgrips 47 mounted on upright frame member 12, for use by the user during the stepping exercises.

Figure 2:
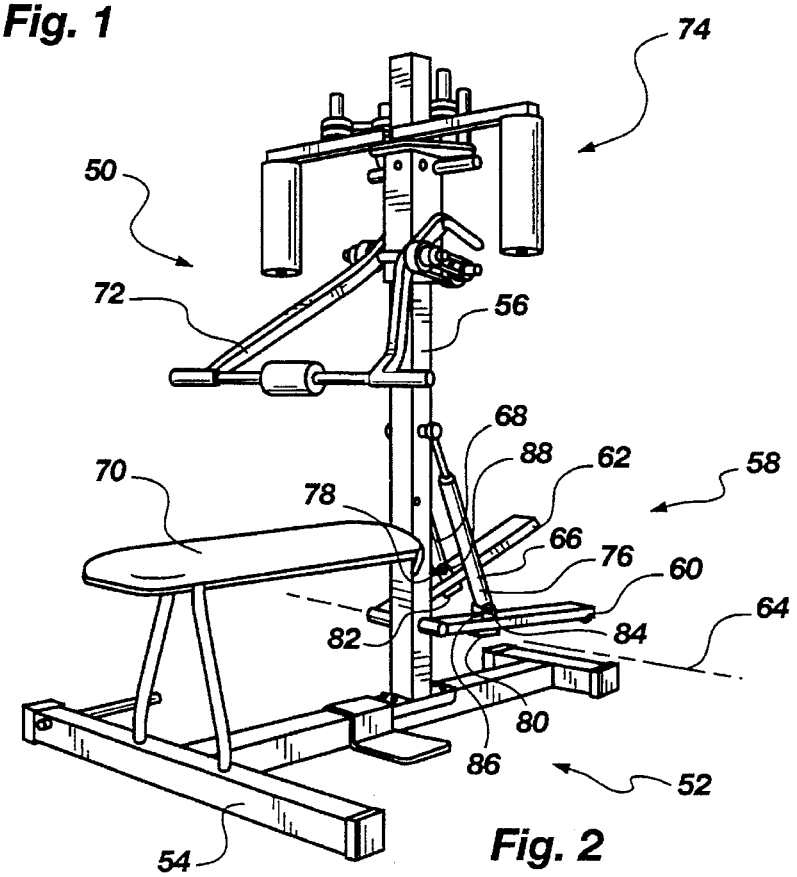
FIG. 2 is a perspective view of the invention as incorporated in a combination exercise machine.

FIG. 2 shows the application of the invention to a multipurpose exercise machine 50. Like the embodiment of FIG. 1, a frame 52 includes a stable base support 54 and an upright frame member 56 attached thereto to support a plurality of exercise devices. An independent stepper exercising apparatus 58 is shown with treadles 60 and 62 pivotally attached to upright member 56 to pivot about axis 64. Each treadle or pedal 60, 62 is also connected to upright frame member 56 by its own hydraulic cylinder device 66, 68. The cylinder devices 66, 68 are detachably connected to the pedals or treadles 60, 62. As shown, each cylinder device 66 and 68 has a bracket 86 and 88 rotatably attached to the lower end 76, 78 thereof. Each bracket is connected to the corresponding treadle by passage of a bolt therethrough. The bolts are not visible in the drawing, but are shown as being retained by nuts 80 and 82. The attachment location for each treadle is individually adjustable, there being a series of bolt holes 84 in each treadle for adjusting the leverage of the user's applied weight against the resistance means and internal biasing means.

An additional effect of such adjustment is the lengthening or shortening of the distance which the cylinder devices 66, 68 extend during the weighting/unweighting cycle. Such variation changes the resistance to downward movement of the treadle 60, 62. The effective resistances to each of a user's feet performing a stepping exercise may therefore be varied for the user by selecting desired hole 84 in each treadle 60, 62 and connecting the lower ends of the cylinders thereto. As shown herein, each hydraulic cylinder device 66, 68 comprises a combination resistance and biasing means for the respective treadle, combining both functions in a single unit. Other embodiments are also described herein.

The multi-purpose exercising machine 50 includes other apparatus for performing various exercises. FIG. 2 depicts a bench 70 attached to frame 52 to support a user thereon during the performance of selected exercises. A lateral bar assembly 72 and a butterfly bar assembly 74 are also included for performing exercises thereon. Other types of exercise apparatus may be incorporated into the machine 50, for performing anaerobic and/or aerobic exercises.

Figure 3:
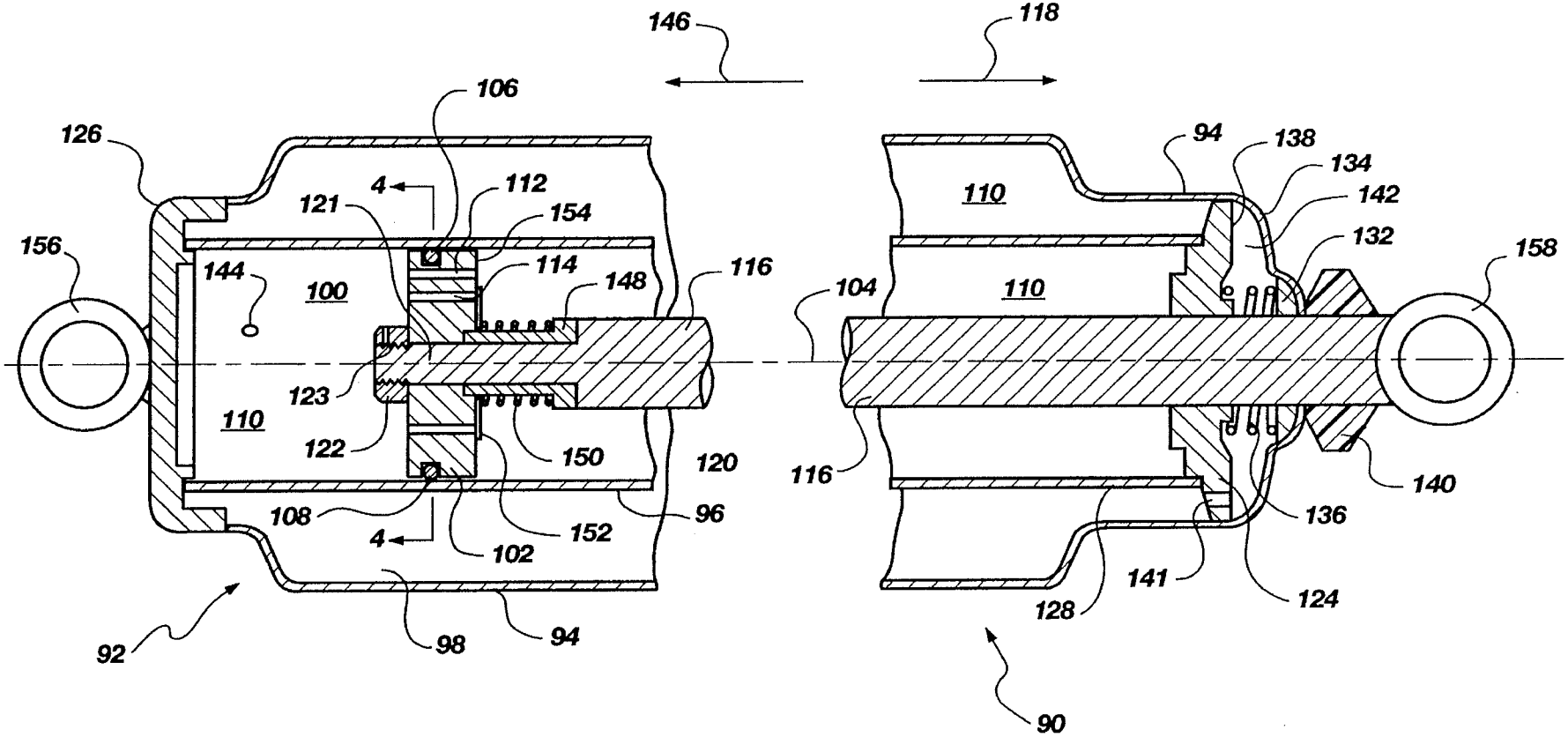
FIG. 3 is a partial lateral cross-sectional view of a hydraulic cylinder device useful as a resistance means in the invention.

FIG. 3 depicts a hydraulic cylinder device 90 which together with a biasing means is useful in the stepper exercise machine. The cylinder device 90 of FIG. 3 has a housing 92 with an external wall 94 and an interior wall 96 with a chamber 98 thereinbetween. The interior wall 96 is formed into a cylinder and in turn defines thereinbetween a second chamber 100. A piston 102 is positioned within the second chamber 100 to slide therein along the axis 104. The piston 102 is cylindrically shaped and sized to snugly and slidably fit within the interior wall 96. An "O"-ring 106 is positioned in an appropriate groove 108 to provide a seal between piston 102 and interior wall 96.

Upon movement of the piston 102 in an axial direction, hydraulic fluid 110 from either side of the piston is forced to flow through appropriately sized apertures 112 and 114 (FIG. 4) formed in the piston 102 or otherwise connecting the two sides of the piston. The apertures here shown are cylindical bores through the piston. The apertures function as orifices to regulate the flow of hydraulic fluid 110 from one side of the piston 102 to the other. The piston 102 is connected to a rod or shaft 116. Shaft 116 is shown with a reduced diameter portion 120 on its interior end 121, portion 120 having threads 123 for attachment to the piston 102 by locknut 122.

Shaft 116 is shown as passing through cylinder endpiece 124 and housing seal 132 to exterior the device 90. Cylinder 96 is shown attached as by welding to end cap 126 of the housing 92. Similarly, endpiece 124 is attached as by welding to the opposite end 128 of cylinder 96.

Seal 132 is registered and held in place against second end cap 134 by seal spring 136, a coil spring compressed against the outer surface 128 of endpiece 124. Seal 132 may comprise an elastomeric member or other type of seal which prevents leakage of hydraulic oil 110 from the housing 92.

The housing 92 is configured to absorb pressure fluctuations caused by thermal expansion of the oil 110. Orifice 141 in endpiece 124 permits migration of oil between chamber 98 and seal chamber 142. Likewise, orifice 144 in the cylinder 96 permits oil migration between chambers 100 and 98.

Means are provided for attaching the housing 92 and the piston shaft 116 to the treadle and frame of the stepper machine. FIG. 3 shows attachment rings 156 and 158 fixed to the end cap 126 and to the outer end 160 of the shaft 116, respectively. Attachment ring 156 is attached to the treadle and ring 158 to the upright frame member (see FIGS. 1 and 2) so that the resistance to downward movement exceeds the return resistance to an upper or ready position.

Also shown is an optional bumper 140 mounted adjacent end ring 158 to limit the inward travel of shaft 116 into the housing 92.

Upon movement of the shaft 116 along the axis 104 in an outward direction 118, hydraulic fluid 110 is ported through apertures 112 which are sized to provide appropriate resistance to movement of stepping treadles such as treadles 22, 24 of FIG. 1 and treadles 60, 62 of FIG. 2.

Upon return movement of the piston 102 in direction 146, hydraulic fluid 110 is ported through apertures 112 and the other apertures 114 (FIGS. 4A and 4B) which contain one-way valves or check valves 115 permitting flow only during inward motion of the piston 102 in direction 146.

Figure 4B:
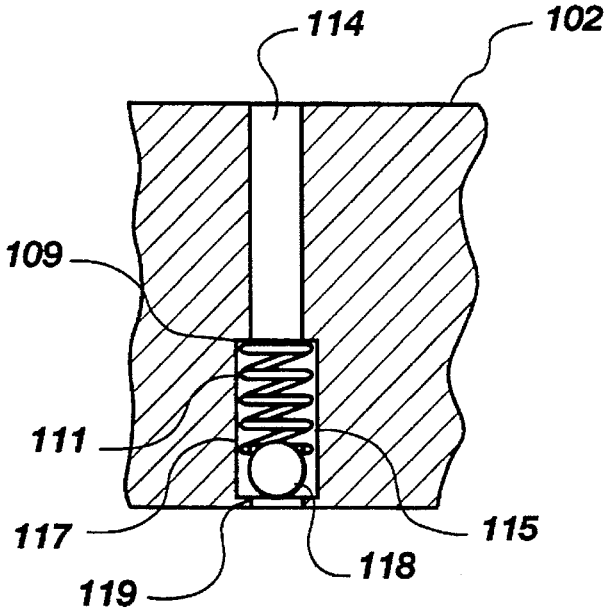
FIG. 4B is an enlarged view of a portion of a piston with a check valve in an orifice.
Figure 4A:
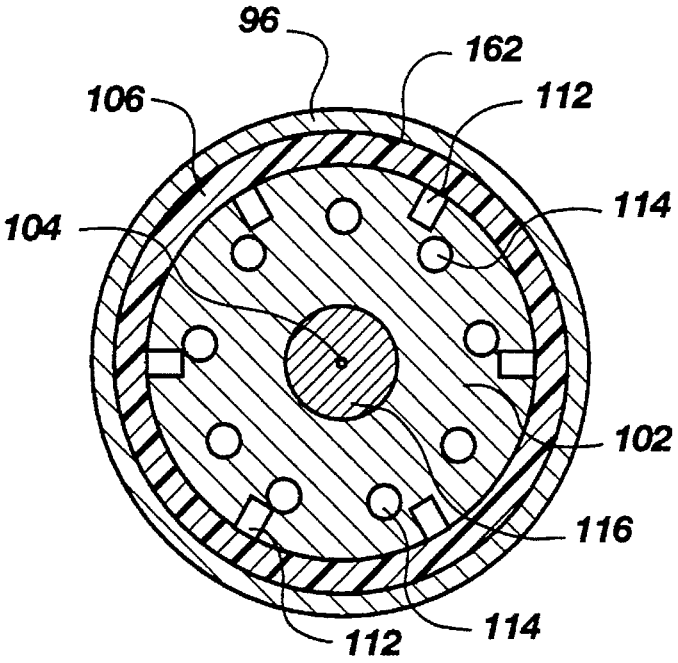
FIG. 4A is a cross-sectional view of a piston for use with the cylinder of FIG. 3, taken along lines 4—4.

As seen in FIG. 4B, the representative check valve 115 has an enlarged chamber 117 with a ball 118 positioned to be urged against valve seat 119 by spring 111 which is seated against collar 109. The force of the hydraulic fluid 110 is sufficient to overcome the spring 111 and unseat the ball 118 to in turn provide for fluid flow through the aperture 114.

As shown in FIG. 3, a collar 148 is mounted on shaft 116. A check value spring 150 is mounted on the collar 148 to compress check valve washer 152 against the piston wall 154. When so compressed, the washer 152 covers one end of each aperture 114 to prevent fluid 110 from passing to the other side of the piston 102 through these apertures. Fluid pressure in the opposite direction, however, lifts the washer 152 from wall 154 against spring 150 to permit fluid flow therethrough as the piston 102 moves in direction 146.

Notably, the combined cross-sectional area available for fluid flow for the aperture or apertures 112 and 114 is larger than the aperture cross-section of the apertures 112 alone, to facilitate return movement of the treadle 60 to its upper or ready position with much reduced resistance. The return resistance is desirably determined and set to provide, with a biasing means, an upwardly directed treadle force which moves the treadle to follow the natural upward stepping speed of the user's foot with minimal upward pressure on the foot, regardless of the lifting speed of the unweighted foot.

It should be noted that the resistance force resulting from fluid flow is a function of velocity, not position. On the other hand, the force applied by the biasing means to the treadle is unidirectional and a function of position, not velocity (disregarding momentum).

FIG. 4 illustrates a cross-section through piston 102 and cylinder 96. Shaft 116 passes through the piston 102 coaxially with central axis 104. An elastomeric O-ring 106 seals the piston 102 against the inner wall 162 of cylinder 96.

Orifices 112 permit fluid flow in either direction 118 or 146 (see FIG. 3). Orifices 114 have one end covered by spring biased washer 152 (FIG. 3) to permit fluid flow in one direction only. Washer 152 may be formed of thin metallic shim stock. The washer 152 with the spring 150 together act as a check valve.

The apparatus of FIG. 3 is used with stepper machine exemplified in FIGS. 1 and 2, without the need for a reciprocating means. The stepper treadles are completely independent in operation to enable the user to exercise in a non-reciprocating fashion. When not in use, both treadles remain in an upper or ready position. When a user merely stands on the treadles, the user will force them to a lower or lowermost position, depending upon the user's weight in comparison with the strength of the biasing means, and the location at which the cylinder devices are attached to the treadles. The resistance to downward movement is comprised of both the static leverage force exerted by the biasing means, and the velocity dependent fluid resistance through the apertures 112.

Figure 5:
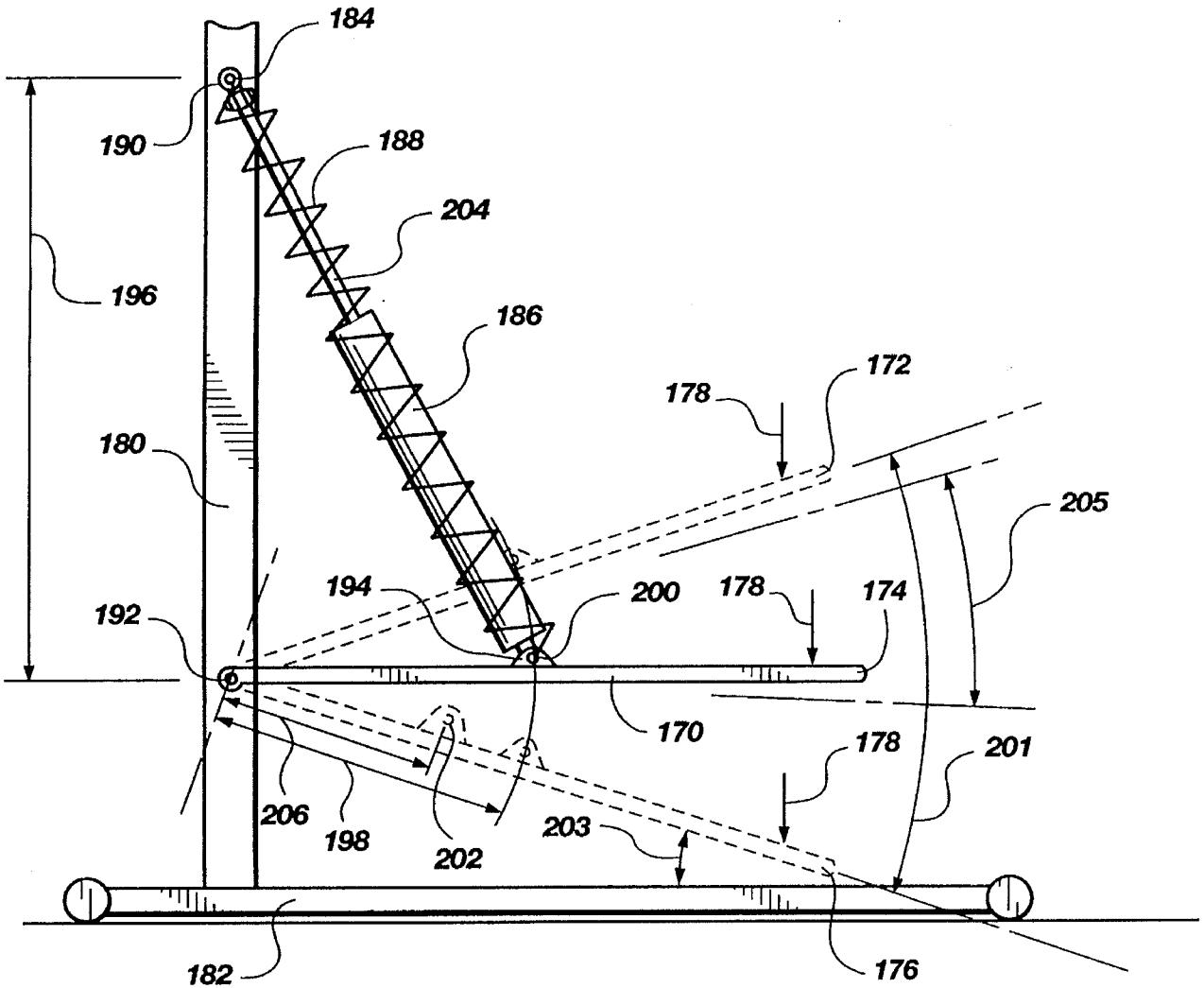
FIG. 5 is a schematic view of the stepper exerciser illustrating the mechanical relationship of a treadle, means for resisting movement, biasing means and upright member to which they are attached.

FIG. 5 depicts the forces acting on a treadle 170 of the invention. The treadle is shown in an upper, ready position 172, a middle position 174 and a lower position 176. The weight exerted by a user's foot is depicted as force 178 and may range from fully weighted, i.e. the user's weight plus additional exerted fore, to fully unweighted. The treadle 170 is pivotally connected to upright member 180 of frame 182 at axis 184. Hydraulic cylinder device 186 comprises a resistance means, and a biasing means is shown as a coil spring 188. Both device 186 and spring 188 are shown as having one end 190 pivotally connected to upright frame member 180 at location 184 spaced 196 vertically from axis 192. The lower ends 194 of device 186 and spring 188 are shown pivotally connected to treadle 170 at a selected position 200 a distance 198 from axis 192. The position may be varied, to vary the leverage, by positioning and locking the lower ends 194 at any of attachment positions 202 spaced along the treadle 170. If desired, the lower end 194 of device 186 may be attached to sliding means, not shown, which is lockable at any position on the treadle 170 to vary the leverage.

Hydraulic cylinder device 186 includes a shaft 204 as described herein.

It can be seen that shaft 204 moves outward from housing 186 as treadle 170 is moved downward from position 172 toward position 176. As the distance from axis 184 to pivot point 200 increases, the force exerted by the spring biasing means 188 increases. The downward speed of the treadle 150 affects the cylinder force resisting its movement. Thus, the resistance to downward movement is the sum of the biasing means 188 (dependent on spring compression which is location-dependent) and hydraulic flow resistance (dependent not on location, but on treadle speed). Both are affected by the applied leverage as controlled by the geometry of the system.

When device 186 and biasing means 188 are connected at a position 202 nearer to axis 192, i.e. at distance 206 therefrom, the same movement speed of treadle 170 from upper position 172 to lower position 176 results in (a) less extension of the biasing means and (b) a lower actual speed of movement of shaft 204 and piston in cylinder 186. Thus, less resistance occurs at position 175 because of less spring compression as well as less hydraulic resistance.

If desired, the biasing means 188 may be mounted on the treadle 170 at a single fixed location, and the resistance means 186 adjustably mounted on the treadle. At a very slow stepping pace with a normal resistance setting, the treadle of such a device will "bottom out" at lower position 176 during each step. Unweighting of the treadle 170 will permit it to rise to the upper position 172. Thus, it travels through a large range 201. The treadle angle 203 in its lower position 176 is uncomfortable, and stopping in that position also disrupts the normal stepping motions.

As a user speeds up the stepping pace, both treadles will operate through a smaller range 205, and the range may be adjusted to be nearer the upper limit of treadle travel. This occurs because the biasing means provides greater upward force when fully actuated than it does when partially or non-actuated. Thus the machine operation may be configured to automatically adjust to the normal upward and downward stepping speeds of a user, within the range of stepping pace desirably used.

Stated alternately, the stepping speed of the machines disclosed can be varied by varying the attachment location of the cylinder to a treadle. It can also be varied by changing the strength of the spring or biasing means.

Figure 6:
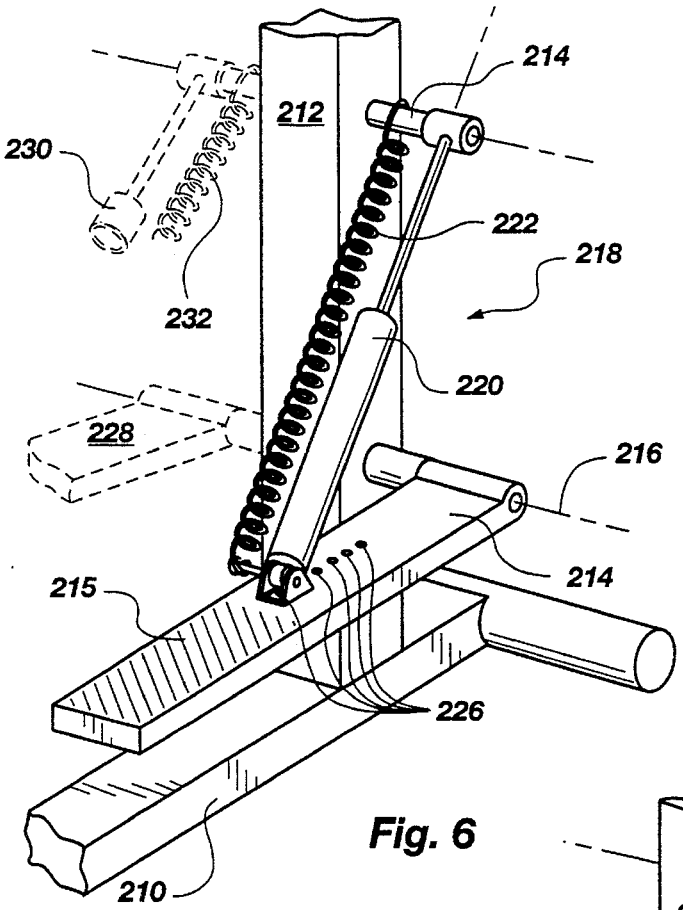
FIG. 6 is a perspective view of one embodiment of the invention.

FIG. 6 illustrates one embodiment of the invention. A stepper frame 210 has an upright member 212, the lower portion only being shown. A stepper treadle 214 having a foot surface 215 is pivotally hinged along axis 216 to upright member 212. Resistance means 218 includes a hydraulic cylinder 220 having internal flow resistance orifices as previously described in relation to FIG. 3. A biasing means 222 is shown as an external coil spring. The biasing means 222 and resistance means 218 are mounted parallel to each other, having one end mounted on pin 224 on upright member 212. The other end is mounted on treadle 214 at one of several locations 226, depending upon the user's weight, desired stepping speed, etc.

Another treadle 228, separated from treadle 214, is shown in "phantom" image together with portions of a cylinder means 230 and biasing spring 232. The two treadles 214 and 228 are completely independent insofar as their action is concerned, each treadle being activated only by one of the user's feet.

Figure 7:
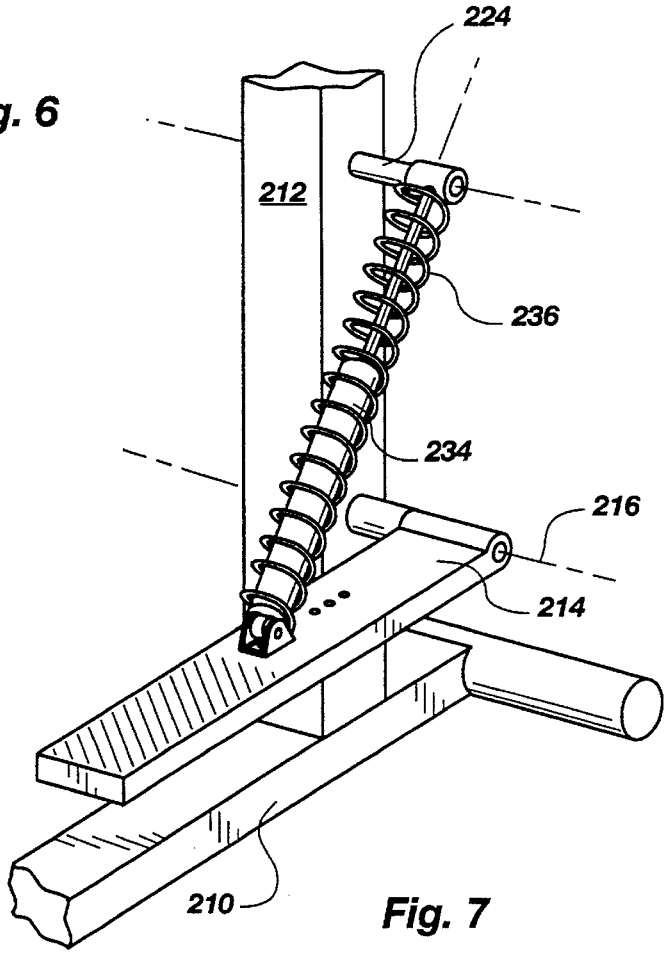
FIG. 7 is a perspective view of another embodiment of the invention.

Another embodiment of the invention is illustrated in FIG. 7. The Figure shows the hydraulic cylinder 234 with a coil spring biasing means 236 wrapped around it. Only one of the treadles 214 is shown. In this configuration, the biasing spring takes up less space than in the configuration of FIG. 6.

Figure 8:
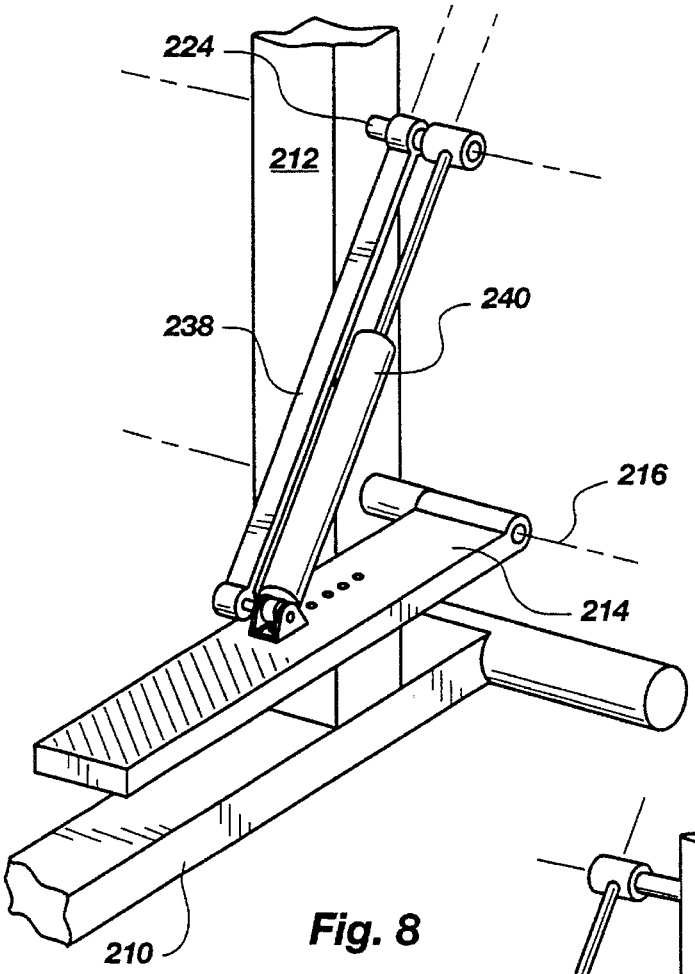
FIG. 8 is a perspective view of a further embodiment of the invention.

As shown in FIG. 8, the coil spring 222 of FIG. 6 is replaced with an elongate elastomeric member 238. The member 238 resists stretching and is selectively sized to bias the treadle 214 to an upper position similarly to a coil spring. The hydraulic device 240 and elastomeric member together provide the desired resistance and return movement.

Figure 9:
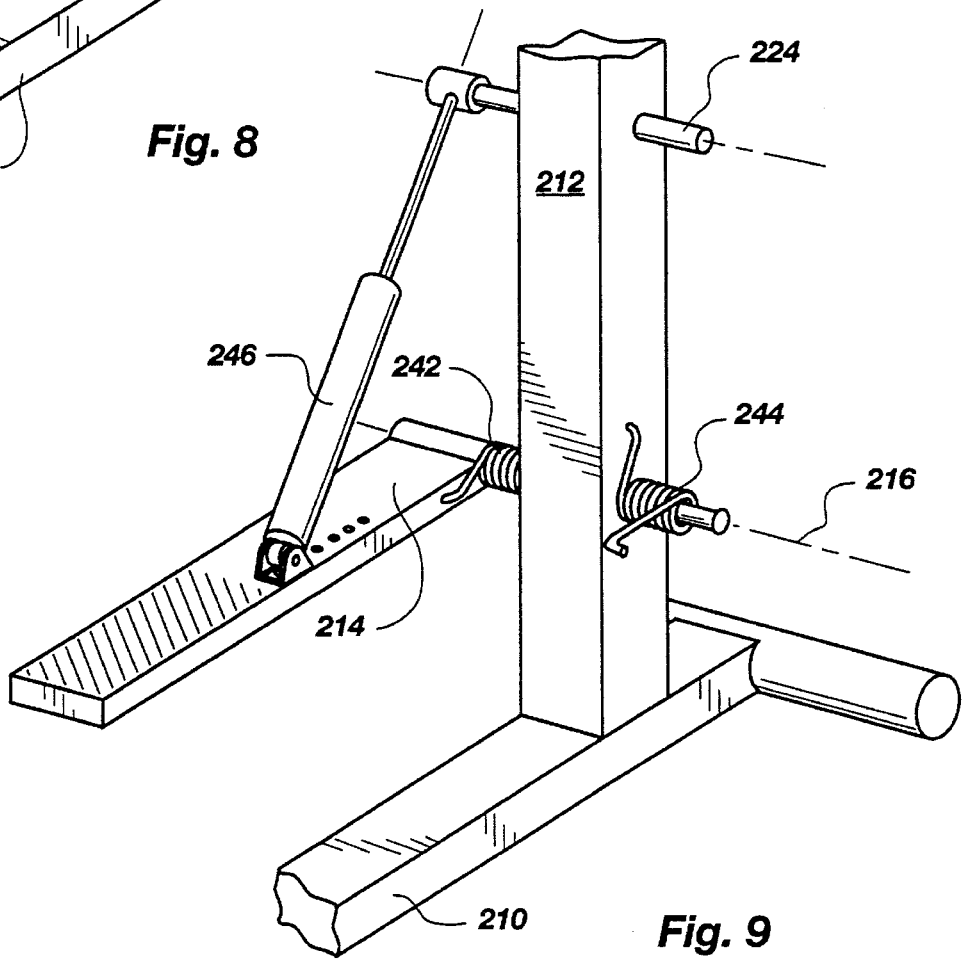
FIG. 9 is a perspective view of another embodiment of the invention.

FIG. 9 illustrates a further embodiment in which the biasing means comprises a pair of torsion springs 242, 244, one for each treadle. The springs are mounted between each treadle and the upright member 212, and also act to separate the two treadles from each other. The hydraulic resistance device 246 and the torsion springs 242, 244 provide the desired action.

Figure 10:
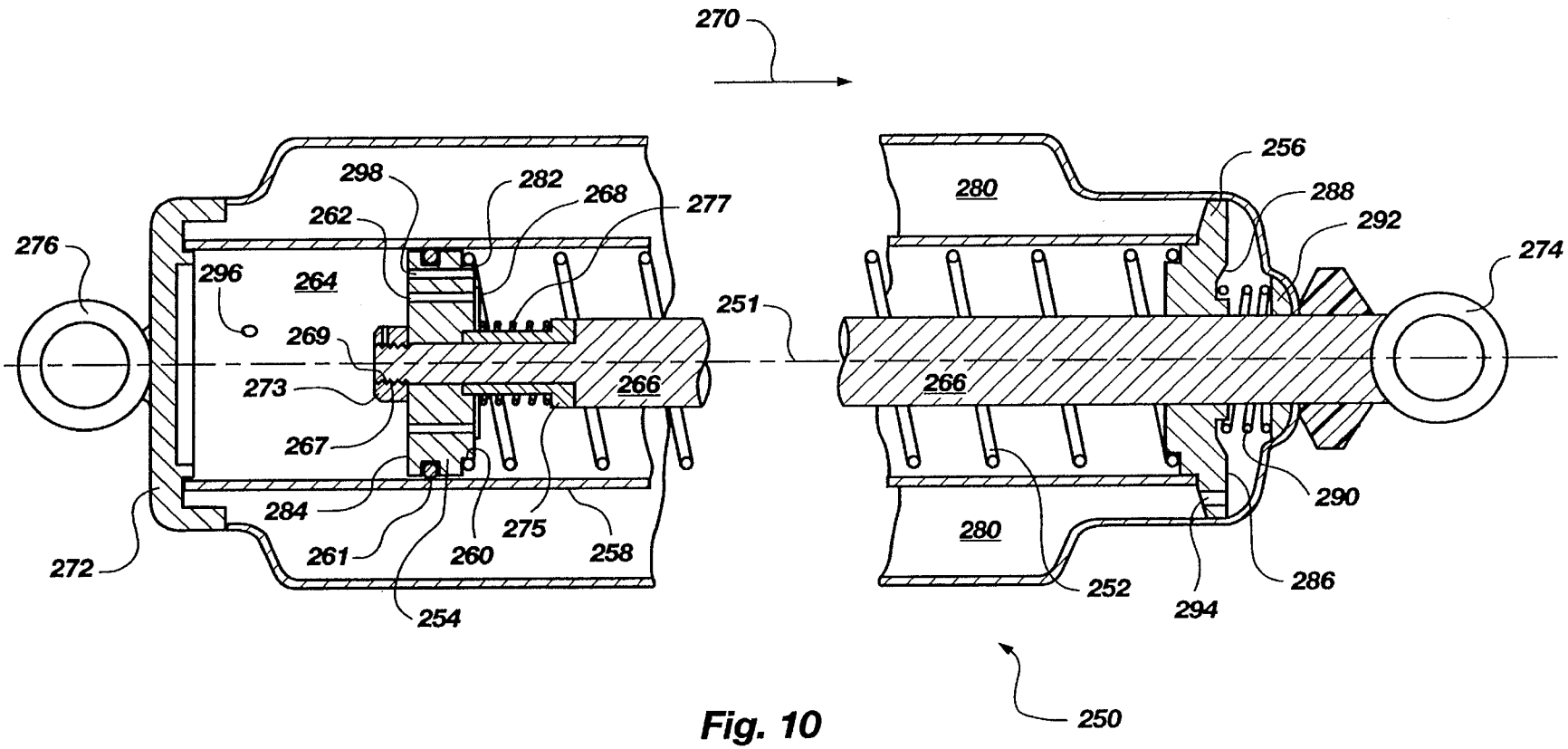
FIG. 10 is a partial lateral cross-sectional view of a still further embodiment of the invention in which the resistance cylinder means and biasing means are combined in a single unit.
Figure 11:
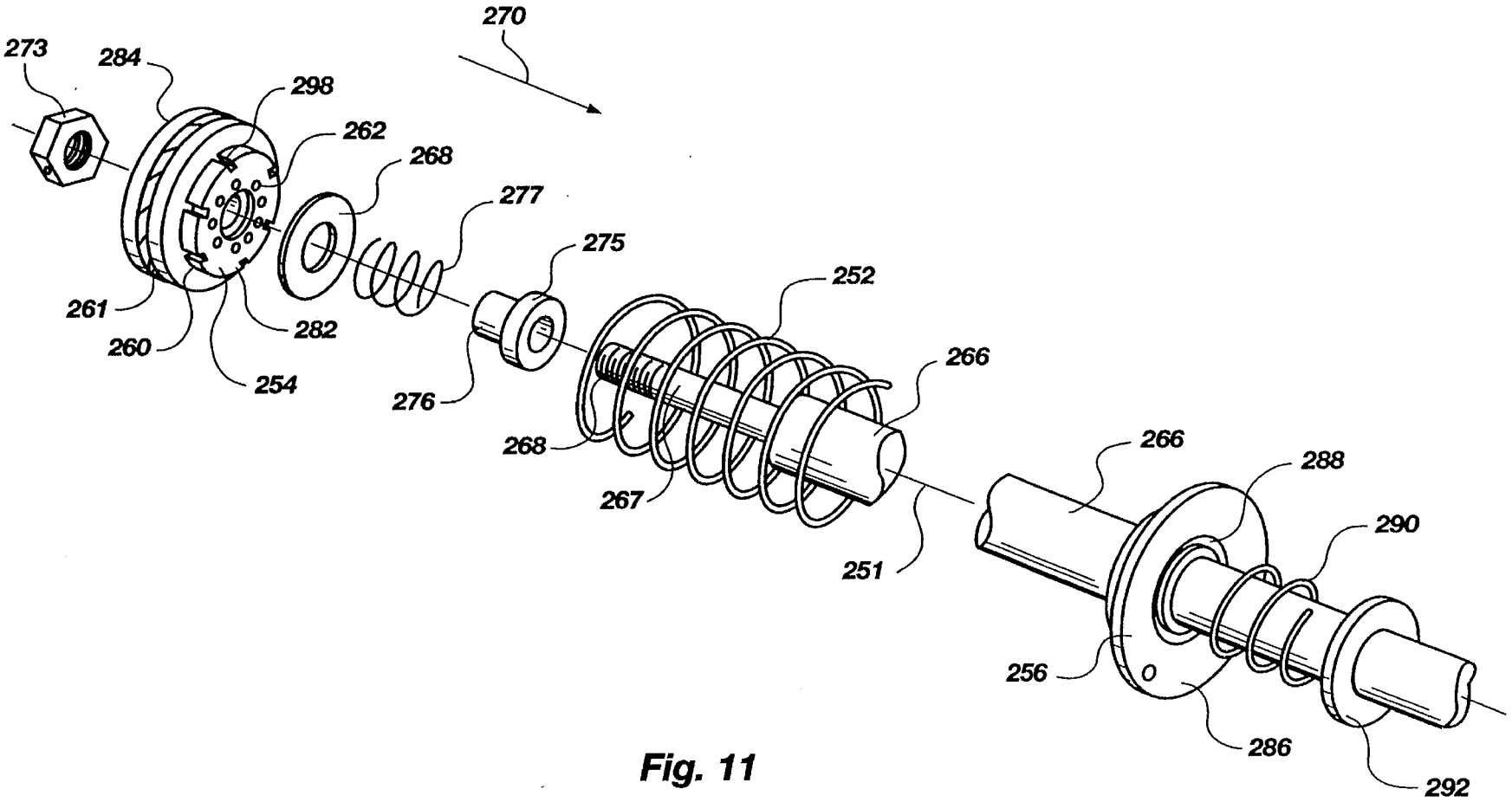
FIG. 11 is an exploded perspective view of the piston, shaft, biasing spring and seal of the combined resistance/biasing means of FIG. 10.

FIGS. 10 and 11 show a hydraulic cylinder device 250 which combines the resistance means and the biasing means in a single cylinder having a central axis 251. The resistance device of FIG. 3 is adapted to hold a compressible coil spring 250 between the piston 254 and the cylinder end piece 256 of the cylinder 258. Spring 252 biases the piston to a "closed" position which moves the treadle upward to a "ready" position.

Piston 254 is shown as having a peripheral shoulder 260 within which spring 252 is registered to maintain its alignment within cylinder 258. In all other respects the cylinder device 250 is as shown in FIGS. 3 and 4 and previously described relative thereto.

The piston 254 includes a peripheral O-ring 261 for sealing the piston within the cylinder 258. The piston 254 is shown fixed to a threaded 269 reduced diameter portion 264 of shaft 266 by locknut 273. Collar 275 is fitted on reduced diameter portion 267, and retains a check valve spring 277 on a reduced end 276. The spring 277 holds washer 268 against piston 254 to overcover the orifices 262, preventing oil flow through the orifices 262 when the pressure on the washer side 282 of the piston is higher than the pressure on the opposite side 284. Orifices 298 permit fluid flow in both directions.

Cylinder end piece 256 is attached to the cylinder 258 as by welding. The end piece 256 is shown with a circular slot 288 in its exterior face 286 into which seal spring 290 fits. Seal spring 290 maintains pressure on shaft seal 292 to prevent leakage from the outer chamber 280. An orifice 294 in the end piece 256 permits pressure equalization across the end piece so that seal 292 does not become overpressurized. An orifice 296 in cylinder permits pressure equalization between the cylinder 258 and chamber 280.

This stepping apparatus motivates the user to maintain a given or minimum stepping speed. Loss of speed results in a dropping of the treadles to an uncomfortable lower position. The resistance force is easily adjusted to compensate for differences in the user's weight and desired speed of operation.

Those skilled in the art will recognize the variations which do not vary from the teachings. The aforedescribed embodiments are not intended to limit the scope of the claims which themselves recite those features regarded as essential to the invention.

What is claimed is:

1. Apparatus for resisting movement of a treadle of a stepper exercising machine, said apparatus comprising:

a pair of treadles, each treadle including an elongate hydraulic cylinder having a first closed end and a second end adapted for passage of a piston shaft therethrough;

a piston sealingly slidable within said cylinder and separating said cylinder into two compartments;

a shaft fixed to said piston and sealingly extending through said second end to exterior said cylinder for pivotal attachment to a stepper machine frame;

an outer cylindrical chamber surrounding said cylinder and communicating therewith at said first closed end for absorbing variations in fluid pressure within said cylinder, said outer chamber sealed from said exterior and configured to be pivotally attached to a stepper machine treadle;

first orifice means passing through said piston for fluid flow therethrough and configured to provide resistance to movement of said piston and shaft;

second orifice means passing through said piston for fluid flow therethrough;

check valve means permitting fluid flow from said first closed end to said second end of said cylinder through said second orifice means to reduce resistance to movement, but restricting fluid flow in the opposite direction; and a compression spring mounted within said cylinder between said piston and said second cylinder end for biasing said piston and shaft toward said first cylinder end, biasing said treadle to an upper ready position, and resisting movement of said treadle toward a lower position.

2. Apparatus for performing stepping exercises, said apparatus comprising:

a frame means for supporting said apparatus;

first and second treadles each pivotally attached to said frame means and each operable between an unweighted position and a weighted position by the weighting and unweighting of a user's foot thereon, with said first and second treadles being separate, spaced from each other, and constructed and associated with said frame neans to be independently operable;

first and second shock absorbers respectively interconnected between said first treadle and said frame means and between said second treadle and said frame means, each of said shock absorbers including:

a hollow cylinder with a hydraulic fluid and a moveable piston therewithin, first orifice means in fluid communication from one side of said piston to the opposite side thereof, said first orifice means providing substantially equal resistance to movement of said moveable piston in both directions, second orifice means in fluid communication from one side of said piston to the opposite side thereof, and check valve means positioned to limit hydraulic fluid flow through said second orifice means to one direction;

wherein in each of said first and second shock absorbers, said hydraulic fluid flows through said first and second orifice means to resist movement of respective said treadles to said unweighted position, and said hydraulic fluid flows only through said first orifice to resist movement of said respective treadles toward said weighted position;

first spring means positioned within said hollow cylinder of said first shock absorber and interconnected between said first treadle and said frame means to bias said first treadle to said unweighted position; and second spring means positioned within said hollow cylinder of said second shock absorber and interconnected between said second treadle and said frame means to bias said second treadle to said unweighted position.

3. Apparatus for performing stepping exercises, said apparatus comprising:

a frame means for supporting said apparatus;

a first and a second treadle each pivotally attached to said frame means and operable between an unweighted position and a weighted position by the weighting and unweighting of a user's foot thereon;

a first shock absorber each interconnected between a respective said and a second treadle and said frame means, and including a hollow cylinder with a hydraulic fluid and a moveable piston therewithin, and orifice means permitting flow of said hydraulic fluid from one side of said piston to the opposite side thereof, and constructed to regulate said flow to have a greater flow rate when a said treadle goes from said weighted position to said unweighted position, and a lower said flow rate when a said treadle goes from said unweighted position to said weighted position; and first and second spring means each operably positioned within respective said hollow cylinder to bias a said treadle to said unweighted position.

4. The apparatus of claim 3, wherein said orifice means includes check valve means operably disposed for limiting said flow to said second flow rate range when said treadle goes from said unweighted position to said weighted position.

5. The apparatus of claim 4, wherein said orifice means includes first and second orifice groups, each said orifice group comprising one or more orifices, and wherein said check valve means is operably disposed to permit said flow through said second orifice group to occur in only one direction.

6. The apparatus of claim 5, wherein said first orifice group is constructed to provide a substantially equal resistance to movement of said moveable piston in both directions.

7. The apparatus of claim 6, wherein said shock absorber further includes valve means for varying said resistance to said flow in said first orifice group.

* * * * *

UNITED STATES PATENT AND TRADEMARK OFFICE

CERTIFICATE OF CORRECTION

PATENT NO. : 5,622,527

DATED : April 22, 1997

INVENTOR(S) : Watterson et al.

It is certified that error appears in the above-indentified patent and that said Letters Patent is hereby corrected as shown below:

In col. 1, line 22, change "stimulate" to --simulate--;

In col. 3, line 62, before "member" insert --frame--;

In col. 5, line 38, change "Cylinder" to --Interior wall--;

In col. 5, line 41, change "cylinder" to --interior wall--;

In col. 5, line 44, change "outer surface 128" to --outer surface 138--;

In col. 5, line 48, change "oil 110" to --hydraulic fluid 110--;

In col. 5, line 49, change "oil" to --fluid--;

In col. 5, line 51, change "cylinder 96" to --interior wall 96--;

In col. 6, line 39, change "cylinder" to --interior wall--;

In col. 6, line 41, change "cylinder" to --interior wall--;

In col. 6, line 42, change "Orifices" to --Apertures--;

In col. 6, line 43, change "Orifices" to --Apertures--;

In col. 6, line 48, after "with" insert --the--;

In col. 7, line 1, change "fore" to --force--;

In col. 7, line 19, change "housing" to --cylinder device--;

In col. 7, line 24, change "150" TO --170--;

In col. 7, line 37, change "175" to --176--;

In col. 7, lines 40-41, change "resistance means 186" to --cylinder device 186--;

UNITED STATES PATENT AND TRADEMARK OFFICE

CERTIFICATE OF CORRECTION

PATENT NO. : 5,622,527

DATED : April 22, 1997

INVENTOR(S) : Watterson et al.

It is certified that error appears in the above-indentified patent and that said Letters Patent is hereby corrected as shown below:

In col. 8, line 25, after "member" insert --238--;

In col. 8, line 38, change "spring 250" to --spring 252--;

In col. 8, line 49, change "portion 264" to --portion 267--;

In col. 8, line 52, change "reduced end 276" to --reduced diameter portion 267--;

In col. 8, line 65, after "cylinder" insert --258--;

In col. 9, line 42, change "cylin" to --closed--;

In col. 9, line 43, delete "der" at the beginning of the line;

In col. 9, line 54, change "neans" to --means--;

In col. 10, line 30, after "first" insert --and a second--;

In col. 10, line 31, delete "and a second";

In col. 10, line 40, after "lower" delete "said";

In col. 10, line 44, after "within" insert --a--;

Signed and Sealed this

Thirtieth Day of September, 1997

*Attest:*

Bruce Lehman

BRUCE LEHMAN

*Attesting Officer*

*Commissioner of Patents and Trademarks*